US006977468B1

(12) United States Patent
Baginski

(10) Patent No.: US 6,977,468 B1
(45) Date of Patent: Dec. 20, 2005

(54) INTEGRATED SPARK GAP DEVICE

(75) Inventor: Thomas A. Baginski, Auburn, AL (US)

(73) Assignee: Auburn University, Auburn, AL (US)

( * ) Notice: Subject to any disclaimer, the term of this patent is extended or adjusted under 35 U.S.C. 154(b) by 0 days.

(21) Appl. No.: 10/770,134

(22) Filed: Feb. 2, 2004

Related U.S. Application Data

(60) Provisional application No. 60/444,433, filed on Feb. 3, 2003.

(51) Int. Cl.[7] ..... H01J 17/30; H01B 37/00
(52) U.S. Cl. ..... 313/602; 315/167
(58) Field of Search ..... 313/595, 596, 313/602, 603; 102/202.4, 202.5; 315/73, 315/127, 167

(56) References Cited

U.S. PATENT DOCUMENTS 3,904,910 A * 9/1975 Schleimann-Jensen ..... 313/325
5,216,325 A * 6/1993 Patel et al. ..... 313/595
5,309,841 A * 5/1994 Hartman et al. ..... 120/202.4
5,861,570 A * 1/1999 Bickes et al. ..... 102/202.7
5,992,326 A * 11/1999 Martinez-Tovar et al. ..... 102/202.4
6,555,961 B1 * 4/2003 Brainard et al. ..... 313/602

OTHER PUBLICATIONS

Lindemuth, et al., "A Computational Model of Exploding Metallic Fuses for Multimegajoule Switching," J. Appl. Phys. vol. 57, No. 9, May 1, 1985, pp. 4447-4460.
Logan, et al., "Calculation of Heating and Burst Phenomena in Electrically Exploded Foils," Journal of Applied Physics, vol. 48, No., 2, Feb. 1977, pp. 621-628.
D.M. Tasca, IEEE Trans. Nucl. Sci. NS-17, 1970, p. 364.
Chau, et al., "Electric Gun: A Versatile Tool for High-Pressure Shock Wave Research. "Rev. Sci. Instrum., vol. 51, No. 12, Dec. 1980, pp. 1676-1681.

* cited by examiner

*Primary Examiner*—Wilson Lee
*Assistant Examiner*—Minh Dieu A
(74) *Attorney, Agent, or Firm*—Gardner Groff, P.C.

(57) ABSTRACT

A spark gap device that is formed in an integrated circuit (IC). The IC has a dielectric substrate upon which a high-voltage switch is disposed. The switch includes an anode element and a cathode element separated from each other by a spark gap. A trigger electrode is disposed on the substrate material in the spark gap. A capacitor is electrically coupled to the trigger electrode. The cathode and anode elements and the trigger electrode preferably are at least partially covered with a dielectric material. When the capacitor is charged, the charge on the capacitor exerts a strong electric field on the cathode and anode elements that causes ions to migrate in the cathode and anode elements toward the spark gap. When the trigger electrode is excited by an electrical current, the ions arc across the gap and a conductive path is created between the cathode element and the anode element.

17 Claims, 4 Drawing Sheets

INTEGRATED SPARK GAP DEVICE

CROSS-REFERENCE TO RELATED APPLICATIONS

The present application claims the benefit of priority to provisional application Ser. No. 60/444,433, filed on Feb. 3, 2003, entitled "TRIGGERED HIGH-VOLTAGE SWITCH", which is incorporated herein by reference in its entirety.

TECHNICAL FIELD OF THE INVENTION

The present invention relates to spark gap devices, and more particularly, to a spark gap device comprising an integrated circuit (IC).

BACKGROUND OF THE INVENTION

Spark gap devices are used to generate large electrical discharges. They typically include a dielectric cylinder, which is often made of a ceramic material such as alumina, an anode on one end of the cylinder, a cathode on the other end of the cylinder and a dielectric material between the anode and cathode that electrically isolates the anode and cathode from each other. The dielectric material is typically a gas, such as argon or nitrogen, or a vacuum. When a large enough potential difference is created across the anode and cathode, the dielectric material inside the cylinder experiences dielectric breakdown and a large electrical discharge crosses the gap between the anode and the cathode.

Spark gap devices are often used in computer systems to protect circuitry from electrostatic discharge, commonly referred to as ESD. Spark gap devices are also used in lightening arrester systems to discharge lightening strikes to ground. Both types of systems apply the same concept, but lightening arrester systems operate at significantly higher potential differences and currents than ESD systems.

Spark gap devices are also used as initiators in explosives. When used for this purpose, the spark gap device includes a trigger that allows a user to actuate the spark gap device at a time of the user's choosing. The trigger is typically an electrode placed between the cathode and anode and electrically isolated from the cathode and anode. The trigger is typically driven by the secondary coil of a step-up transformer, which generates a large enough electrical field between the trigger electrode and the cathode to cause ions to begin accumulating in the gap between the cathode and the electrode. When enough ions have accumulated in the gap, migration of ions begins between the cathode and the anode and the device switches on, i.e., a short circuit occurs between the cathode and anode.

The breakdown voltage that causes the spark gap device to switch on is normally very large, e.g., thousands of volts, and the breakdown current may be thousands of amperes. In order for a spark gap device to withstand such large breakdown currents, the device is typically constructed of discrete components capable of dissipating large amounts of power. To date, it has not been feasible to embed spark gap devices in ICs because discharging a very large voltage over a very small area on an IC over a clock cycle causes a very large amount of energy to be released, which will essentially vaporize the IC.

A need exists for a spark gap device that is capable of operating at a very high voltage and that is capable of being fabricated on an IC.

SUMMARY OF THE INVENTION

The present invention provides a spark gap device that is formed in an integrated circuit (IC). The IC has a dielectric substrate material upon which a high-voltage switch is disposed. The high-voltage switch includes an anode element and a cathode element separated from each other by a spark gap. A trigger electrode is disposed on the substrate material. A capacitor is electrically coupled to the trigger electrode. The cathode and anode elements and the trigger electrode preferably are at least partially covered with a dielectric material. When a voltage source charges the capacitor, the charge on the capacitor exerts a strong electric field on the cathode and anode elements that causes ions to migrate in the cathode and anode elements toward the spark gap. When the trigger electrode is excited by an electrical current, the ions arc across the gap and a conductive path is created between the cathode element and the anode element.

In accordance with an embodiment of the present invention, the high-voltage switch is integrated together with an explosive device on the IC. The explosive device also includes a cathode element and an anode element. The cathode and anode elements of the explosive device are interconnected by a narrow conductive bridge. When the high-voltage switch is actuated, current is conducted through the high-voltage switch to the explosive device, which may be a slapper device or exploding bridge wire (EBW) device, for example. The current flowing through the explosive device passes through the conductive bridge causing the explosive device to detonate. A variety of different trigger mechanisms can be used to excite the trigger electrode to actuate the high-voltage switch.

The integrated spark gap device of the present invention has many advantages over existing spark gap devices. One of the advantages of the integrated spark gap device of the present invention is that, because IC batch processing techniques can be used to produce the device, the device can be mass produced at very low cost. This is not the case with known EBW and some slapper devices, which are made of discrete components that must be assembled. Another advantage of the spark gap device of the present invention results from the very small size of the device. The IC package that contains the device can be inserted directly into the explosive fill of munitions or into warheads. Because no additional room is required for the spark gap device, munitions can be reduced in size. This size reduction can have many beneficial effects, including, for example, an increase in the number of ordinates that can be carried on an aircraft. Another advantage is that multiple IC packages containing the spark gap devices can be inserted into the explosive fill to provide multi-point detonation capabilities.

These and other features and advantages of the present invention will become apparent from the following description, drawings and claims.

DETAILED DESCRIPTION OF THE INVENTION

Figure 1:
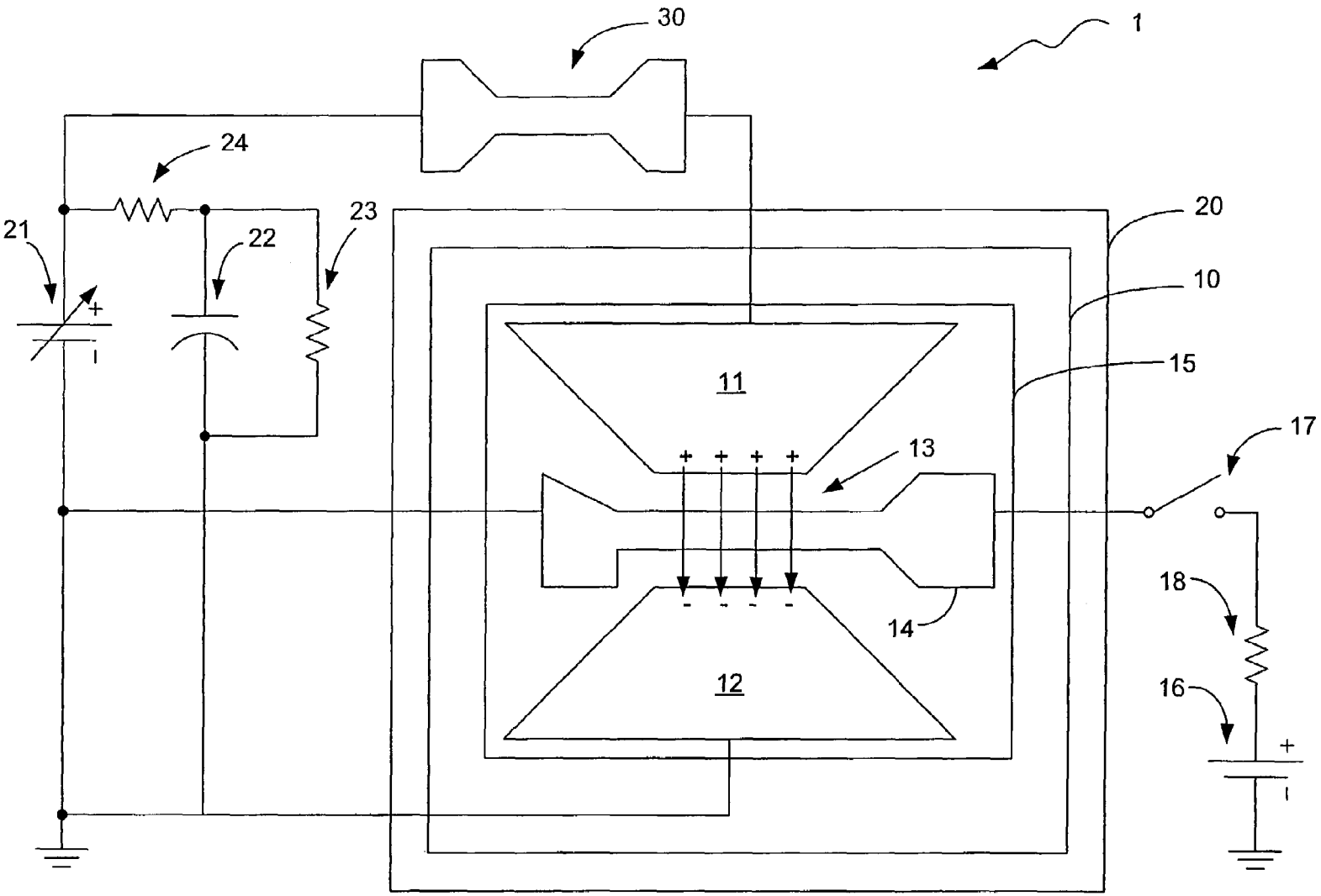
FIG. 1 is a schematic diagram of the spark gap device of the present invention in accordance with an embodiment.

The present invention is a spark gap device that is capable of operating at high voltages and that is fabricated on an integrated circuit (IC). The term "integrated circuit", as that term is used herein, is intended to denote a circuit comprising components that are integrated together on a substrate material. The substrate material is not limited to any particular type of material. FIG. 1 illustrates a plan view of a schematic diagram of the integrated spark gap device 1 of the present invention in accordance with an embodiment. The layout shown in FIG. 1 is one of many possible layouts that can be used for the integrated spark gap device 1. The present invention is not limited to any particular IC layout for the spark gap device.

In accordance with the embodiment shown in FIG. 1, the integrated spark gap device comprises a high-voltage switch 10 formed on a substrate material 20. In accordance with this embodiment, the substrate material 20 is a dielectric material such as alumina, for example. Alumina is a ceramic material that has a high dielectric constant. The switch 10 has an anode element 11 and a cathode element 12, which are electrically isolated from each other by an air gap 13. A trigger electrode 14 is located in the gap 13 and is electrically isolated from the anode element 11 and the cathode element 12. The switch 10 is preferably covered with a thin layer of a dielectric material 15, such as polyimide, for example.

Typical lithographic techniques may be used to fabricate the spark gap device 1. The anode and cathode elements 11 and 12 comprise a conductive material, such as copper, for example. The trigger electrode 14 also comprises a conductive material, such as copper, for example. The anode and cathode elements 11 and 12 and the trigger electrode 14 may be put down on the substrate material 20 using any of a variety of techniques, such as vapor deposition, for example. The anode and cathode elements 11 and 12 and the trigger electrode 14 may be patterned using any of a variety of known techniques, such as photoresist masking and etching, for example. The anode and cathode elements 11 and 12 and the trigger electrode 14 may be disposed on a layer of titanium (not shown), which functions as an adhesive layer to cause the copper to adhere to the alumina. The anode and cathode elements 11 and 12 and the trigger electrode 14 may be covered with a layer of anti-oxidizing material (not shown), such as gold, for example.

The trigger electrode 14 is electrically coupled to a voltage source 16. A switch 17 is actuated to cause current to be provided to the trigger electrode 14. A resistor 18 controls the magnitude of the current provided to the trigger electrode 14. The switch 17 may be any type of switch including, for example, a field effect transistor (FET), a bipolar junction transistor (BJT), a mechanical switch, an electromechanical switch, etc.

The high-voltage switch 10 is electrically coupled to a variable voltage supply 21, to a high-voltage capacitor 22, to a bleed resistor 23 and to a current limiting resistor 24. The capacitor 22 stores a large electrical charge that will be used to generate a spark in the spark gap device 1. The electrical charge is placed on the capacitor 22 by increasing the voltage supply 21. Once the capacitor 22 has been charged, actuation of the spark gap device 1 is controlled by controlling the actuation of the switch 17.

When the capacitor 22 is charged, an large electric field is exerted on the anode and cathode elements 11 and 12, which causes ions to migrate in the anode and cathode elements 11 and 12 toward the gap 13. When the switch 17 is actuated, current is provided to the trigger electrode 14 through the switch 17. The current provided to the trigger electrode 14 causes the trigger electrode 14 to vaporize. When the electrode 14 vaporizes, a plasma gas is released. The release of the plasma gas pushes up on the coating of polyimide 15 in the region of the gap 13, allowing the ions in the anode and cathode elements 11 and 12 to arc across the gap 13. The voltage differential between the anode and cathode elements 11 and 12 just prior to arcing is equal to or greater than approximately 300 volts.

The arcing of the ions across the gap 13 creates a conductive path through the high-voltage switch 10. The current conducted through the high-voltage switch 10 flows through an explosive device 30 causing the explosive device 30 to detonate. The explosive device 30 may be a known explosive device, such as, for example, a known exploding bridge wire (EBW) device or a known slapper device. If a known explosive device is used, the explosive device will be connected to an electrical contact region of the substrate material 20. Such known devices typically comprise discrete components. The capacitor 22 may be surface mounted to the IC by soldering electrical terminals of the capacitor 22 to electrical contacts (not shown) on the IC. The voltage source 21 and resistors 23 and 24 may be connected to the IC through similar electrical contacts on the IC.

As an alternative to using a known explosive device, the present invention provides an integrated explosive device that is integrated on the substrate material with the high-voltage switch 10. The monolithically integrated high-voltage switch and explosive device of the present invention will now be described with reference to FIGS. 2 and 3. The spark gap device 40 of the present invention shown in FIG. 2 includes the high-voltage switch 10 shown in FIG. 1 and described above, and an explosive device 60. The high-voltage switch 10 and the explosive device 60 are disposed on a substrate material 50. The substrate material 50 may be a ceramic material, such as alumina, for example. The high-voltage switch 10 and the explosive device 60 preferably are covered with a layer of polyimide 51, although other dielectric coatings are suitable for this purpose. The components 16–18 and 21–24 shown in FIG. 1 are identical to components 16–18 and 21–24 shown in FIG. 2.

Figure 2:
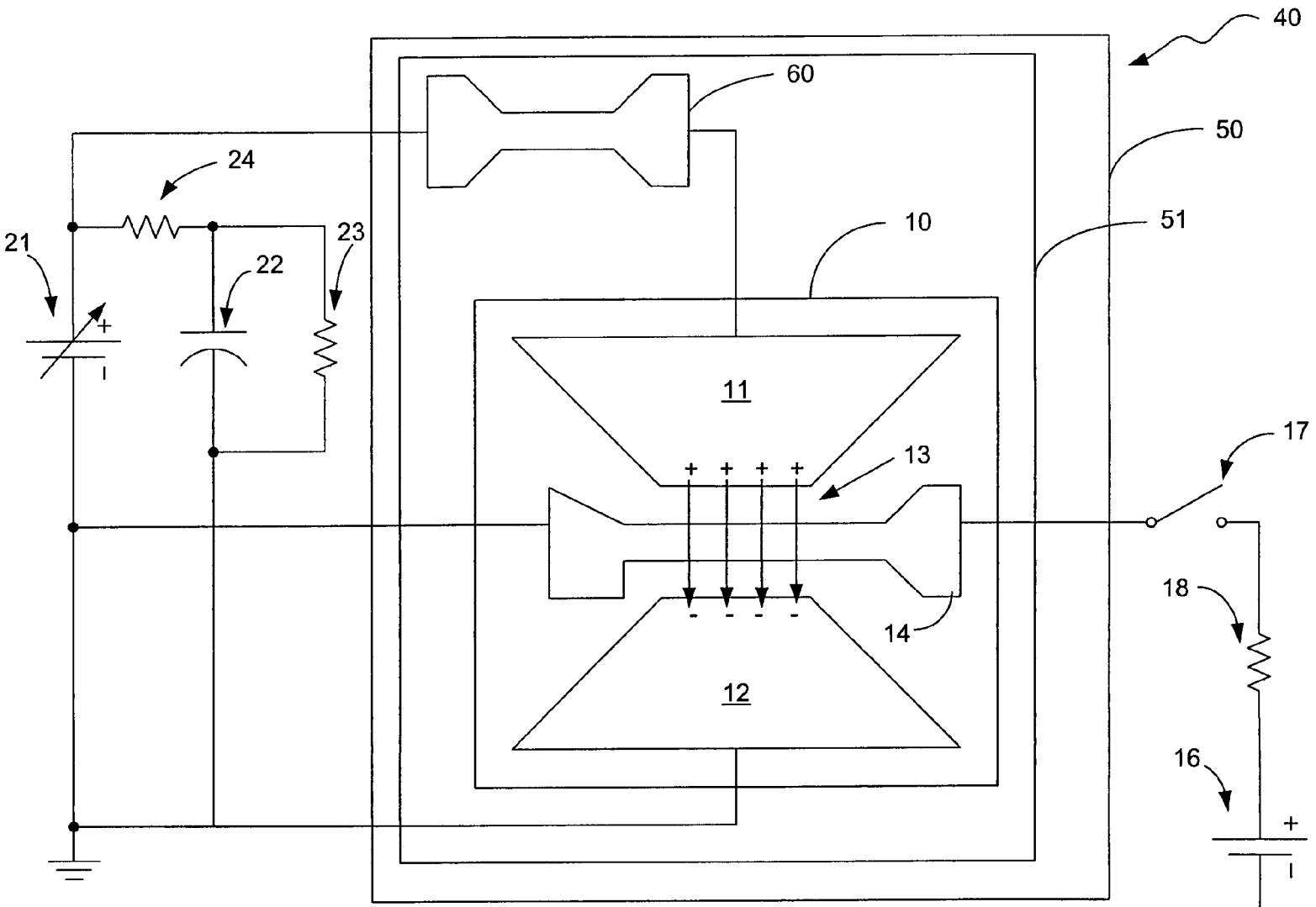
FIG. 2 is a schematic diagram of the spark gap device of the present invention in accordance with another embodiment.
Figure 3:
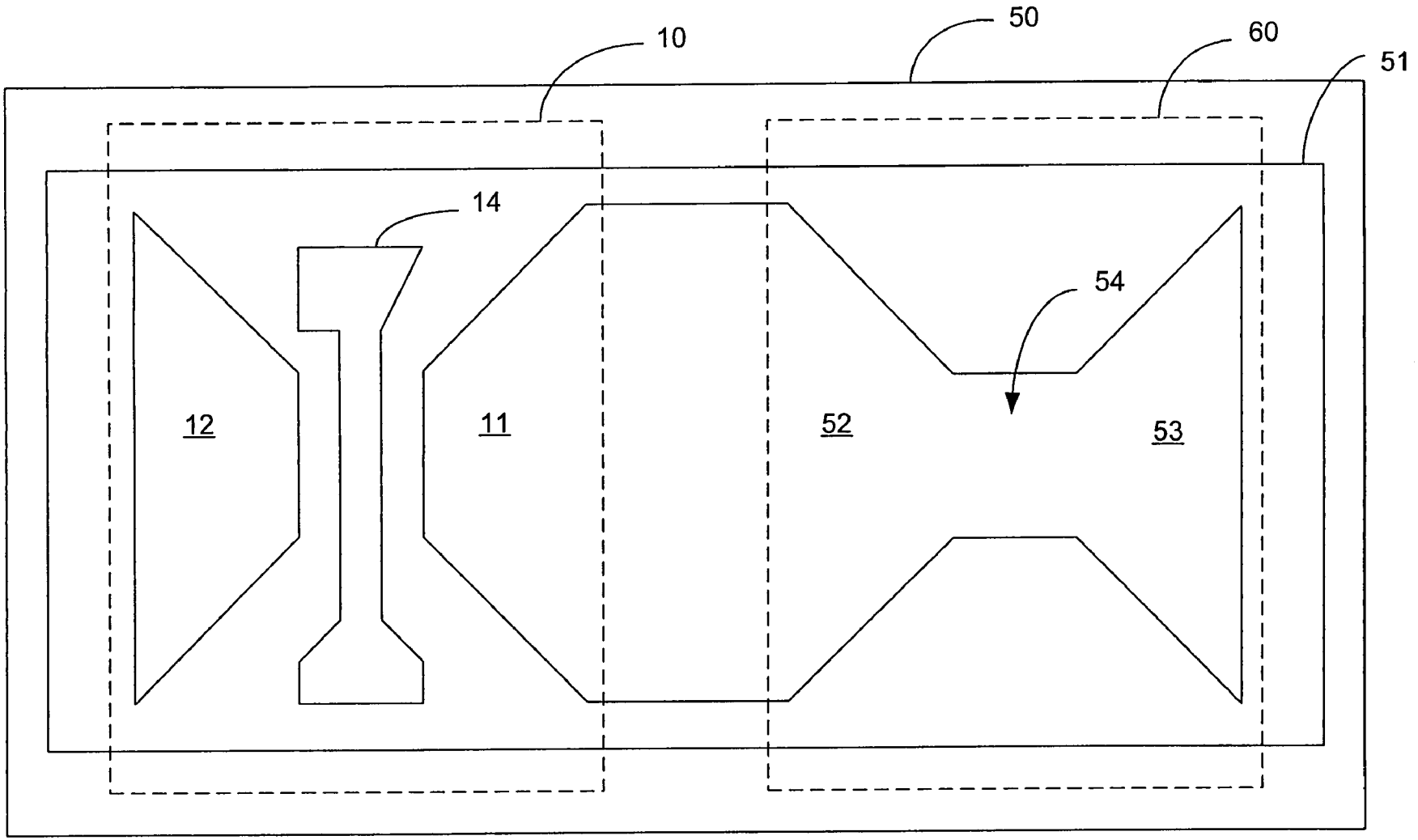
FIG. 3 is a plan view of an IC layout of a portion of the spark gap device shown in FIG. 2.

FIG. 3 is a plan view of a portion of the spark gap device 40 shown in FIG. 2. The portion of the spark gap device 40 shown in FIG. 3 includes the high-voltage switch 10 and the explosive device 60 integrated together on the substrate material 50. When the trigger electrode 14 is vaporized, ions arc across the gap 13 between the anode element 11 and the cathode element 12 creating a conductive path for current to flow through. The current flows into the explosive device 60. Like the high-voltage switch 10, the explosive device 60 includes an anode element and a cathode element. The cathode and anode elements 52 and 53, respectively, of the explosive device 60 are interconnected by a narrow conductive bridge 54. The cathode and anode elements 52 and 53 interconnected by the narrow bridge 54 form a conductive region that has a generally bow-tie shape.

When the current is forced through the narrow conductive bridge 54, the bridge 54 is vaporized, thereby causing a plasma gas to be released. The release of the plasma gas causes the portion of the polyimide layer 51 covering the bridge 54 to be pushed upwards away from the bridge at a very high speed. This portion of the polyimide layer 51 functions as a flyer of a slapper device. The force of the gas on the polyimide causes the portion of the polyimide layer above the bridge 54 to tear away from the explosive device 60. The very short impulse response associated with the movement of the polyimide generates a sufficient amount of energy to detonate an explosive substance. Without the polyimide layer 51 covering the bridge 54, the explosive device 60 operates simply as an exploding bridge wire (EBW) device. While the bow-tie shape of the conductive region made up of the cathode element 52, the anode element 53 and the bridge 54 works well for vaporizing the bridge 54, the present invention is not limited to this particular configuration.

Figure 4:
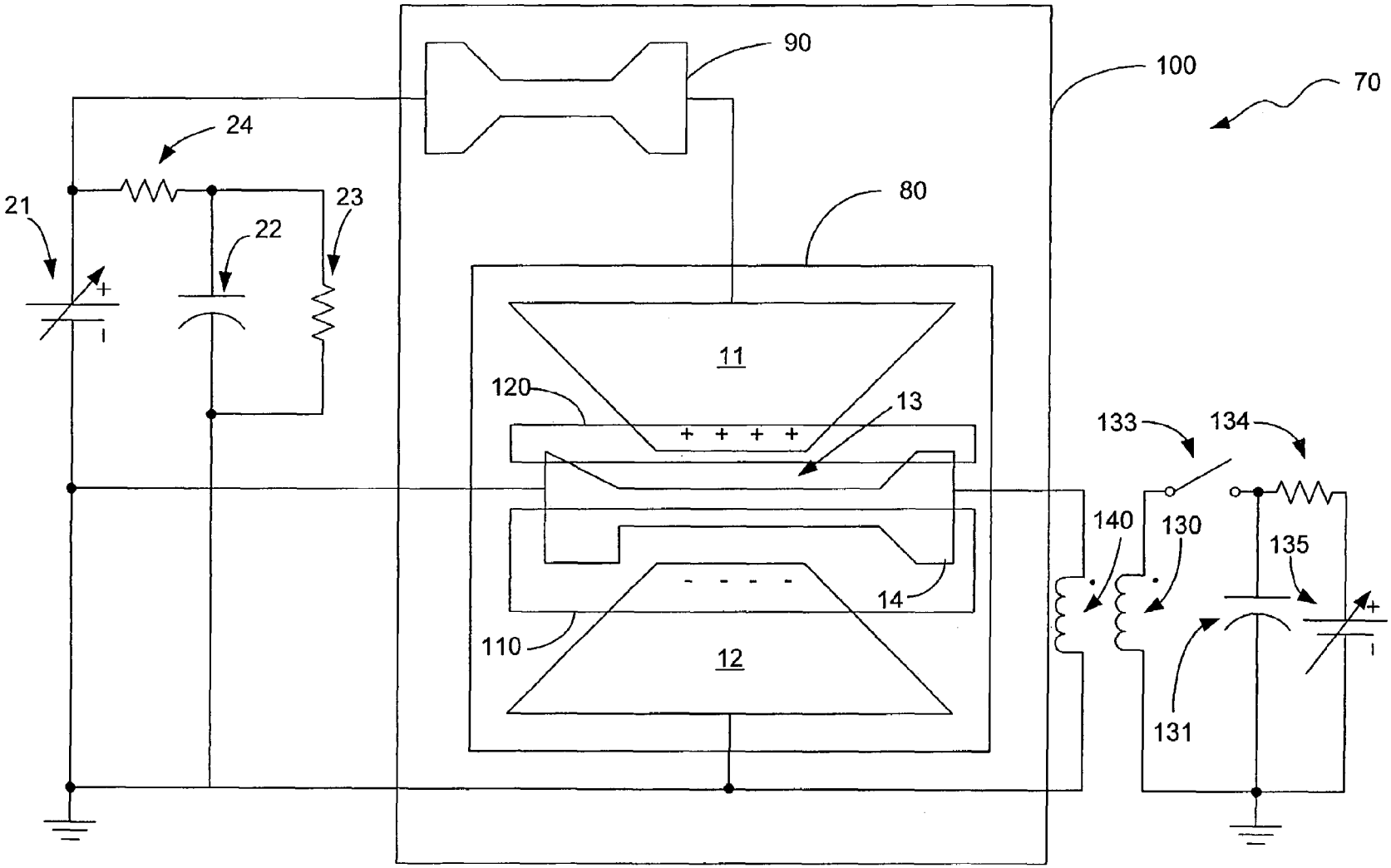
FIG. 4 is a schematic diagram of the spark gap device of the present invention in accordance with another embodiment.

FIG. 4 is a schematic diagram of the spark gap device of the present invention in accordance with another embodiment. Like the spark gap device 40 shown in FIG. 2, the spark gap device 70 shown in FIG. 4 includes a high-voltage switch 80 and an explosive device 90 integrated together on a single substrate material 100. However, in accordance with the embodiment shown in FIG. 4, preferably only a portion of the high-voltage switch 80 is covered with polyimide. In addition, as described below in detail, the triggering mechanism of the spark gap device 70 does not vaporize the trigger electrode 14, which means that the high-voltage switch 80 can be fired multiple times.

A first strip of polyimide 110 covers a portion of the cathode element 12 near the gap 13 and a portion of the trigger electrode 14. A second strip of polyimide 120 covers a portion of the anode element 11 near the gap 13. The partial covering of the anode and cathode elements 11 and 12 and trigger electrode 14 with the polyimide strips 110 and 120 enables the high-voltage switch 80 to stand off a very large voltage before arcing occurs between the anode and cathode elements 11 and 12.

The triggering mechanism of the spark gap device 70 shown in FIG. 4 includes a step-up transformer comprising a primary side inductor 130 and a secondary side inductor 140. The inductor 140 of the secondary side is connected to the trigger electrode 14 of the high-voltage switch 80. The inductor 130 of the primary side of the transformer is part of an L-C circuit that comprises the inductor 130, a capacitor 131, and a switch 133. The capacitor 131 is in parallel with a variable voltage source 135, which is in series with a current limiting resistor 134. When the switch 133 is actuated, the capacitor 131 is charged by the voltage source 135. As the capacitor 131 charges, the transformer 130 couples the voltage stored on the capacitor 131 to the trigger electrode 14. Like the embodiments described above with reference to FIGS. 1 and 2, charging of the capacitor 22 by the voltage source 21 causes an electric field to be exerted on the anode and cathode elements 11 and 12. Exertion of the electric field on the anode and cathode elements 11 and 12 causes ions to begin migrating to the portions of the anode and cathode elements 11 and 12 near the gap 14. When the voltage differential across the gap 14 becomes great enough, the ions arc across the gap 14 creating a conductive path through the switch 80.

Current flows through the conductive path between the anode and cathode elements 11 and 12 and into the explosive device 90, which may be identical to the explosive device 60 shown in FIGS. 2 and 3. When current passes through the bridge of the explosive device 90, a plasma gas is released, thus detonating the explosive device 90. The explosive device 90 may or may not be covered with polyimide, depending on whether the explosive device 90 is to function as an EBW or as a slapper device.

The L-C circuit of the triggering mechanism shown in FIG. 4 has a timing constant that can be readily determined. Because the timing constant can be readily determined, the high-voltage switch 80 can be actuated with very precisely timing. Consequently, the explosive device 90 can be detonated with very precise timing.

It should be noted that while the present invention has been described with reference to particular embodiments, the present invention is not limited to these embodiments. Persons skilled in the art will understand, in view of the description provided herein, that many variations can be made to the embodiments described herein without departing from the scope of the invention. For example, the present invention is not limited to any particular shape for the cathode and anode elements or trigger electrode. Also, the present invention is not limited to any particular materials for the substrate, anode element, cathode element or trigger electrode. Also, materials other than polyimide are suitable for covering the gap and trigger electrode of the high-voltage switch and the bridge of the explosive device. Other variations may be made to the embodiments described herein and all such variations are within the scope of the present invention.

What is claimed is:

1. A spark gap device comprising:

an integrated circuit (IC), the IC comprising:

a substrate;

a cathode element disposed on the substrate, the cathode element comprising a conductive material; and an anode element disposed on the substrate electrically isolated from the cathode element, the anode element comprising a conductive material, the anode and cathode elements being separated from each other by a spark gap;

a capacitor that stores an electrical charge, the electrical charge stored on the capacitor exerting an electric field over the cathode and anode elements; and a trigger electrode capable of being actuated;

a dielectric layer covering at least portions of each of the cathode element, the anode element, the trigger electrode, and the spark gap, wherein when the trigger electrode is actuated, an electrical current passes through the trigger electrode causing at least partial vaporization of the trigger electrode, said at least partial vaporization of the trigger electrode causing a plasma gas to be released that moves a portion of said dielectric layer away from the spark gap to allow ions to flow across the spark gap between the cathode element and the anode element.

2. The spark gap device of claim 1, wherein the substrate is a ceramic material.

3. The spark gap device of claim 1, wherein when the trigger electrode is actuated, a voltage differential between the cathode element and the anode element is approximately 300 volts or greater.

4. The spark gap device of claim 1, wherein the trigger electrode includes an electrode electrically isolated from the cathode and anode elements and substrate, wherein the trigger electrode is actuated by creating a voltage differential between the electrode and the cathode element.

5. The spark gap device of claim 1, wherein the trigger electrode is electrically coupled to a secondary side of a step-up transformer, the secondary side comprising a coil that is electrically isolated from the cathode element, anode element and substrate.

6. The spark gap device of claim 1, wherein the trigger electrode is electrically coupled to a transistor, and wherein the trigger electrode is actuated by applying a voltage to a gate of the transistor.

7. The spark gap device of claim 1, wherein the spark gap device is a high-voltage switch for use as an electrostatic discharge (ESD) device in a computer system.

8. The spark gap device of claim 1, further comprising:

a slapper device formed on the IC, the slapper device being electrically connected in series with the spark gap device, the slapper device comprising:

a cathode element disposed on the substrate, the cathode element of the slapper device comprising a conductive material;

an anode element disposed on the substrate electrically isolated from the cathode element of the slapper device, the anode element of the slapper device comprising a conductive material;

a conductive bridge interconnecting the cathode element of the slapper device and the anode element of the slapper device; and a flyer element positioned to receive energy transferred from the conductive bridge of the slapper device to the flyer element, wherein when the trigger element of the spark gap device is actuated, current flows through the conductive bridge of the slapper device thereby causing energy to be transferred from the conductive bridge of the slapper device to the flyer element, the energy transferred to the flyer element imparting motion to the flyer element in a direction away from the substrate.

9. The spark gap device of claim 8, wherein the IC is used in an explosive as an initiator, wherein the motion of the flyer device imparts energy to an explosive material in the explosive to cause the explosive material to detonate.

10. An explosive apparatus comprising:

a spark gap device, the spark gap device comprising:

an integrated circuit (IC), the IC comprising:

a substrate;

a cathode element disposed on the substrate, the cathode element comprising a conductive material; and an anode element disposed on the substrate electrically isolated from the cathode element, the anode element comprising a conductive material;

a capacitor capable of storing a large electrical charge; and a trigger capable of being actuated;

a dielectric layer covering at least portions of each of the cathode element, the anode element, the trigger electrode, and the spark gap, wherein when the trigger electrode is actuated, an electrical current passes through the trigger electrode causing at least partial vaporization of the trigger electrode, said at least partial vaporization of the trigger electrode causing a plasma gas to be released that moves a portion of said dielectric layer away from the spark gap to allow ions to flow across the spark gap between the cathode element and the anode element; and an explosive material that is detonated when the trigger is actuated.

11. The explosive apparatus of claim 10, wherein the substrate is a ceramic material.

12. The explosive apparatus of claim 10, wherein when the trigger is actuated, the voltage differential between the cathode element and the anode element is at least equal to or greater than approximately 300 volts.

13. The explosive apparatus of claim 10, wherein the trigger includes an electrode electrically isolated from the cathode element, anode element and substrate.

14. The explosive apparatus claim 10, wherein the trigger includes a secondary side of a step-up transformer electrically coupled to a trigger electrode.

15. The explosive apparatus of claim 10, wherein the trigger includes a transistor electrically coupled to an electrode.

16. The explosive apparatus of claim 10, further comprising:

a slapper device, the slapper device being electrically connected in series with the spark gap device, the slapper device comprising:

a cathode element disposed on the substrate, the cathode element of the slapper device comprising a conductive material;

an anode element disposed on the substrate electrically isolated from the cathode element of the slapper device, the anode element of the slapper device comprising a conductive material;

a conductive bridge interconnecting the cathode element of the slapper device and the anode element of the slapper device; and a flyer element positioned to receive energy transferred from the conductive bridge of the slapper device to the flyer element, wherein when the trigger of the spark gap device, current flows through the conductive bridge of the slapper device thereby causing energy to be transferred from the conductive bridge of the slapper device to the flyer element, the energy transferred to the flyer element imparting motion to the flyer element in a direction away from the substrate to cause the flyer element to contact the explosive material, wherein the contact between the flyer element and the explosive material causes the explosive material to detonate.

17. A method for generating a spark, the method comprising:

integrally forming a high-voltage switch on a substrate of an integrated circuit, the high-voltage switch comprising an anode element disposed on the substrate and a cathode element disposed on the substrate, the anode and cathode elements being electrically isolated from each other and separated from each other by a spark gap;

integrally forming an explosive device of the substrate, the explosive device comprising an anode element, a cathode element and a conductive bridge element that connects the anode and cathode elements of the explosive device together; and triggering the high-voltage switch to cause a spark to be created in the spark gap, wherein when the spark is created in the spark gap, current flows through the conductive bridge of the explosive device thereby causing the explosive device to detonate.

* * * * *